US010018001B2

(12) United States Patent
Riordan

(10) Patent No.: US 10,018,001 B2
(45) Date of Patent: Jul. 10, 2018

(54) CENTRALISING DEVICE AND METHOD THEREFOR

(71) Applicant: MATRIX COMPOSITES & ENGINEERING LTD, Henderson (AU)

(72) Inventor: Paul Riordan, Malaga (AU)

(73) Assignee: Matrix Composites & Engineering Ltd., Henderson, WA (AU)

( * ) Notice: Subject to any disclaimer, the term of this patent is extended or adjusted under 35 U.S.C. 154(b) by 294 days.

(21) Appl. No.: 14/892,853

(22) PCT Filed: May 20, 2014

(86) PCT No.: PCT/AU2014/000528
§ 371 (c)(1),
(2) Date: Feb. 5, 2016

(87) PCT Pub. No.: WO2014/186825
PCT Pub. Date: Nov. 27, 2014

(65) Prior Publication Data

US 2016/0123095 A1 May 5, 2016

(30) Foreign Application Priority Data

May 21, 2013 (AU) ..... 2013901816

(51) Int. Cl.
*E21B 19/24* (2006.01)

(52) U.S. Cl.
CPC ..... *E21B 19/24* (2013.01)

(58) Field of Classification Search
CPC ..... E21B 19/24; E21B 17/10; E21B 17/1078
See application file for complete search history.

(56) References Cited

U.S. PATENT DOCUMENTS 3,142,343 A * 7/1964 Otteman ..... E21B 7/128 166/355
7,013,824 B2 3/2006 Otten et al.
2013/0312978 A1* 11/2013 Galle, Jr. ..... E21B 17/1057 166/355

FOREIGN PATENT DOCUMENTS

CN 202544776 U 11/2012

OTHER PUBLICATIONS

International Search Report dated Jul. 9, 2014 from PCT/AU2014/000528, 5 pages.

(Continued)

*Primary Examiner* — Brad Harcourt
(74) *Attorney, Agent, or Firm* — Ohlandt, Greeley, Ruggiero & Perle, L.L.P.

(57) ABSTRACT

The present disclosure provides a centralizing device and a method for using the centralizing device to immovably centralize a conductor casing within an aperture of a supporting framework. The centralizing device has one or more body portions, each having an inner surface and an outer surface, wherein the inner surface(s) are arranged for abutting the conductor casing and the outer surface(s) are arranged for abutting the framework. The body portion(s) are located within the aperture between the conductor casing and the framework for limiting movement of the conductor casing relative to the framework. Each body portion includes a first member providing the outer surface and a second member providing the inner surface. The first member and second member are movable relative to each other, to thereby permit adjusting the position of the inner surface relative to the position of the outer surface, so as to centralize the conductor casing within the aperture.

15 Claims, 5 Drawing Sheets

(56) References Cited

OTHER PUBLICATIONS

Written Opinion dated Jul. 9, 2014 from PCT/AU2014/000528, 4 pages.
International Preliminary Report on Patentability dated Jul. 17, 2015 from PCT/AU2014/000528, 13 pages.

* cited by examiner

CENTRALISING DEVICE AND METHOD THEREFOR

BACKGROUND OF THE DISCLOSURE

1. Field of the Disclosure

The present invention relates to a centralising device for use with equipment arranged to be placed in or through an aperture.

More particularly, the present invention relates to a centralising device for use in centralising a conductor or a conductor casing within an aperture extending through a deck plate of an off-shore drilling rig.

2. Description of the Related Art

It is known to pass elongate equipment, such as a conductor, through an aperture in a deck plate of an off-shore drilling rig and for the conductor to extend downwardly through a plurality of deck plates in order to reach a drilling site. Known methods and devices for centralising the conductor within the deck plate aperture involve the provision of a conductor casing having a plurality of outwardly extending ribs spaced about the outer surface of the conductor casing. When the conductor casing is located in the deck plate aperture an outer portion of the ribs abuts against the surrounding deck plate such that the conductor casing is held to be generally centralised within the deck plate aperture.

In practice it is difficult w properly align a longitudinal axis of the conductor casing along a central axis of the deck plate aperture. Having the conductor casing positioned off-centre within the deck plate aperture results in an eccentric annular space between the conductor casing and the surrounding deck plate. Therefore the deck plate aperture is normally made substantially larger than an effective external outer diameter (as formed by the projecting ribs) of the conductor casing so that the conductor casing can be located within the deck plate aperture without undue difficulty.

However this method results in an excess amount of slack between the outer portion of the ribs and the deck plate and permits the conductor casing to drift laterally or rattle within the deck plate aperture. Such drift leads to an excessive amount of noise production due to the rattling of the ribs against the deck plate. The noise produced by the rattling causes a distraction to rig personnel, leading to a potential danger.

Furthermore, issues of wear and galvanic corrosion occur due to the touching metallic surfaces of the conductor casing and the metallic deck plate of known centralising devices.

The present invention attempts to overcome, at least in part, the aforementioned disadvantages of previous devices for centralising a conductor casing within a deck plate aperture.

SUMMARY OF THE DISCLOSURE

In accordance with a first aspect of the present invention, there is provided a centralising device for use in centralising a conductor casing within an aperture of a supporting framework, the centralising device comprising a body portion having an inner surface and an outer surface; the inner surface being arranged for abutting the conductor casing; and the outer surface being arranged for abutting the framework; the body portion being adapted to be located in the aperture between the conductor casing and the framework for limiting movement of the conductor casing relative to the framework.

The body portion may include adjustment means for enabling a relative movement between the inner surface and the outer surface.

The relative movement may be either lateral movement in a tangential dimension of the conductor casing or lateral movement in a radial dimension of the conductor casing.

The body portion may include a first member and a second member, the second member being movable relative to the first member, wherein the outer surface is provided on the first member and the inner surface is provided on the second member.

The first member may have a recess adapted to substantially receive at least a portion of the second member therein.

The centralising device may include a packer member being adapted to be located between the first member and the second member to cause the movement of the first member relative to the second member.

The centralising device may include a locking member for selectively limiting the relative movement between inner surface and the outer surface.

The body portion may be made from a plastics material or a composite plastics material.

The centralising device may include a plurality of body portions adapted to be arranged adjacent to each other in an annular configuration for surrounding the conductor casing.

The centralising device may include at least three body portions.

The supporting framework may be a deck plate of a drill rig.

The aperture may have an annular configuration or an eccentric annular configuration.

In accordance with a further aspect of the invention, there is provided a method for centralising a conductor casing within an aperture of a supporting framework, the method comprising the steps:

of providing a centralising device having a body portion with an inner surface and an outer surface, wherein the inner surface is arranged for abutting the conductor casing and the outer surface is arranged for abutting the framework; and of locating the body portion in the aperture between the conductor casing and the framework, so that it limits movement of the conductor casing relative to the framework.

The method may include the step of adjusting the position of the inner surface relative to the position of the outer surface.

The method may include the step of inserting a packer member between a first member, comprising the outer surface, and a second member, comprising the inner surface, the second member being movable relative to the first member, to cause adjustment of the position of the inner surface relative to the position of the outer surface.

The method may include the step of locking the body portion to selectively prevent any adjustment of the position of the inner surface relative to the position of the outer surface.

The method may include the use of a centralising device as described herein.

BRIEF DESCRIPTION OF DRAWINGS

The present invention will now be described, by way of example, with reference to the accompanying drawings, in which.

DETAILED DESCRIPTION OF THE DISCLOSURE

Figure 1:
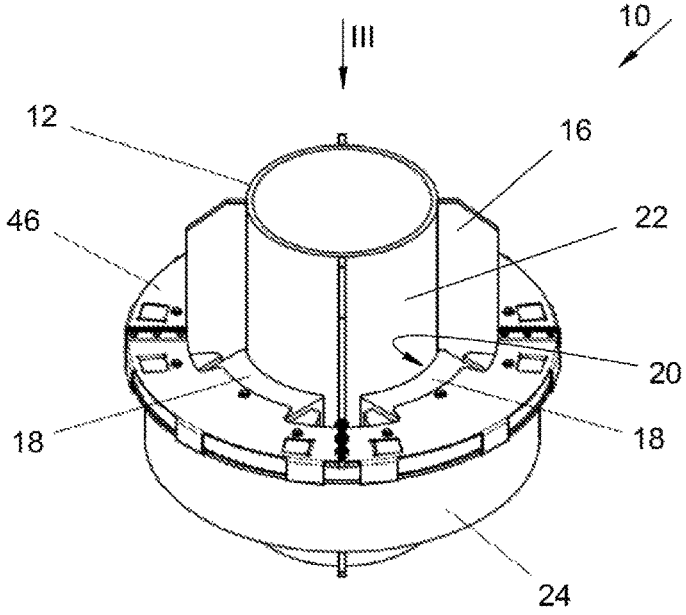
FIG. 1 shows an upper perspective view of a preferred embodiment of a centralising device according to the present invention, shown in use locating a conductor casing.
Figure 2:
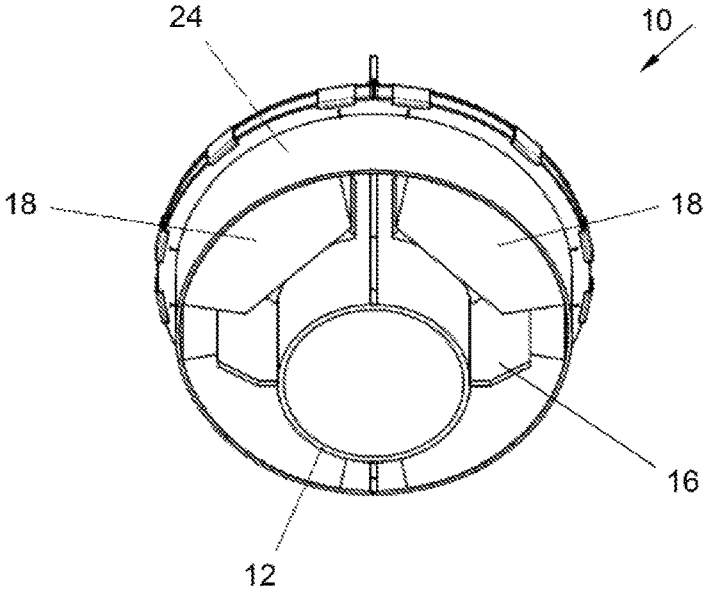
FIG. 2 shows a lower perspective view of the centralising device of FIG. 1.
Figure 3:
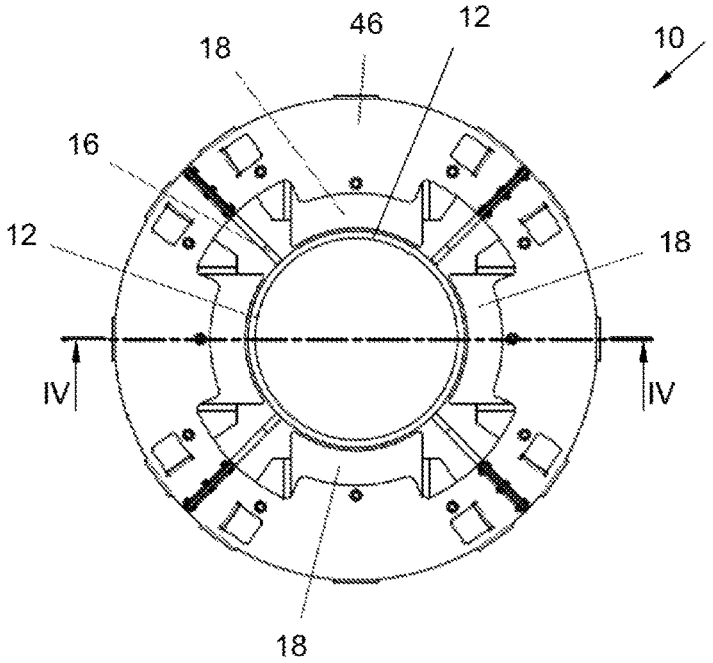
FIG. 3 shows a top plan view of the centralising device seen along arrow III in FIG. 1.
Figure 4:
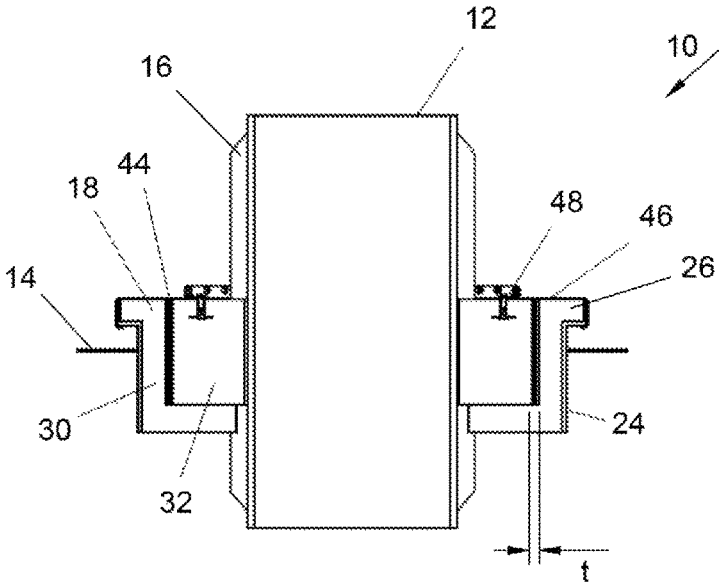
FIG. 4 shows a sectional side view of the centralising device seen along arrows III-III in FIG. 3.
Figure 5:
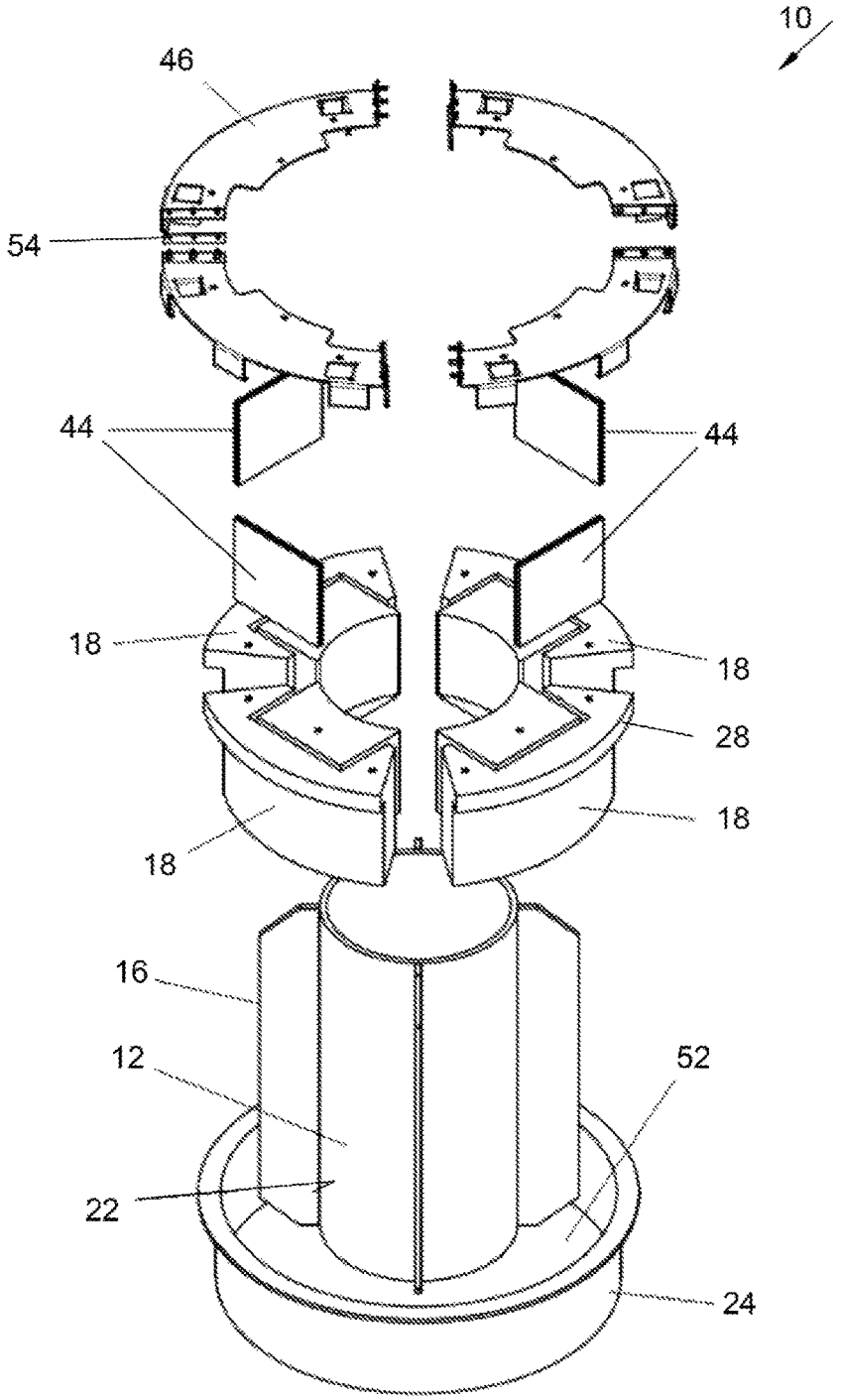
FIG. 5 shows an exploded upper perspective view of the centralising device of FIG. 1.

Referring to FIGS. 1 to 5, there is shown a centralising device 10 in accordance with a preferred embodiment of the invention. The centralising device 10 is adapted to surround a conductor casing 12 or other tubular element so as assist in locating the conductor casing 12 within an aperture of a supporting framework, such as a deck plate 14 (see FIG. 4).

Typically the centralising device 10 will have a generally annular configuration as shown in the Figures as it is more common in practice for the conductor casing 12 to be cylindrical for location within a circular or cylindrical aperture through the deck plate 14. However it should be understood that the centralising device 10 may be configured to be complementary to a conductor casing 12 of any shape and also complementary to an aperture of any shape.

Further, in some instances the conductor casing 12 is provided with one or more outwardly projecting ribs 16 extending longitudinally along the conductor casing 12. The preferred embodiment of the centralising device 10 is herein described as being configured to abut against the conductor casing 12 between the ribs 16. However, without varying from the scope of the present invention, the centralising device 10 may easily be arranged to abut against both the conductor casing 12 and the ribs 16. Of even to abut only against the ribs 16.

In the preferred embodiment shown, the centralising device 10 comprises a number of identical separate body portions 18 being adapted to form a ring-like structure annularly surrounding the conductor casing 12. In the exemplary embodiment four body portions 18 are employed as this provides an effective solution for centralising the conductor casing 12 having four orthogonally spaced ribs 16. However it should be understood that more or less body portions 18 can be used as required or desired in any particular application, for example a conductor casing without any ribs may be centralised using a centralising device 10 having either three or five body portions 18.

Figure 6:
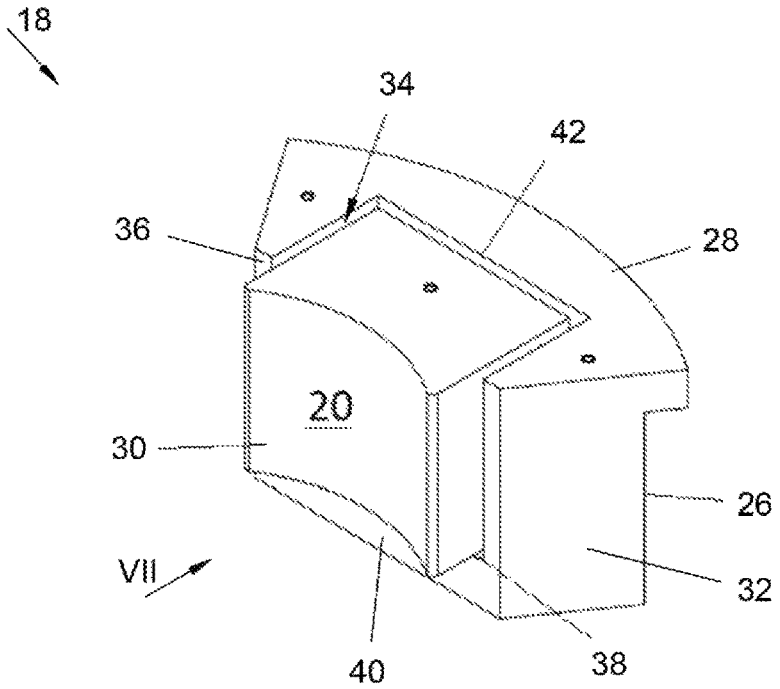
FIG. 6 shows an upper perspective view of a body portion forming part of the centralising device.
Figure 7:
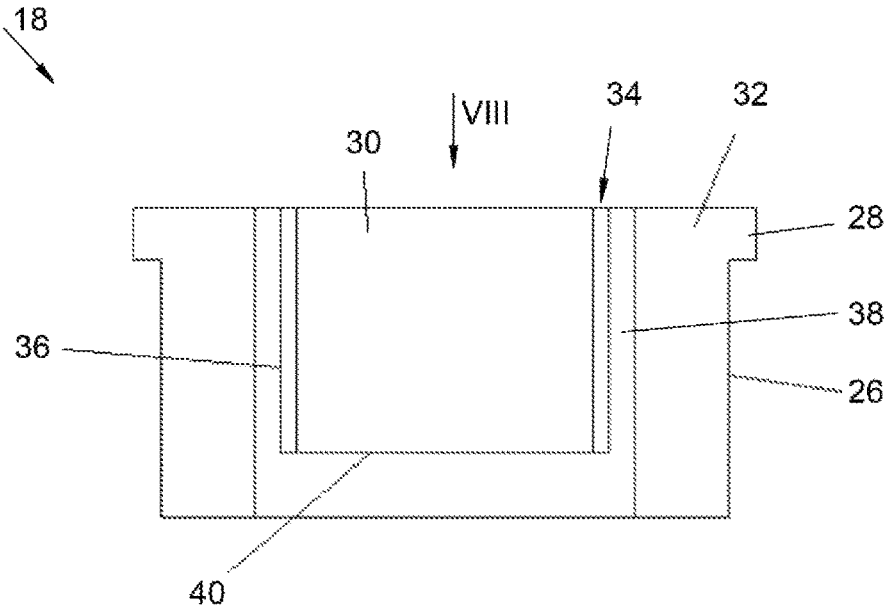
FIG. 7 shows a front view of the body portion seen along arrow VII in FIG. 6.
Figure 8:
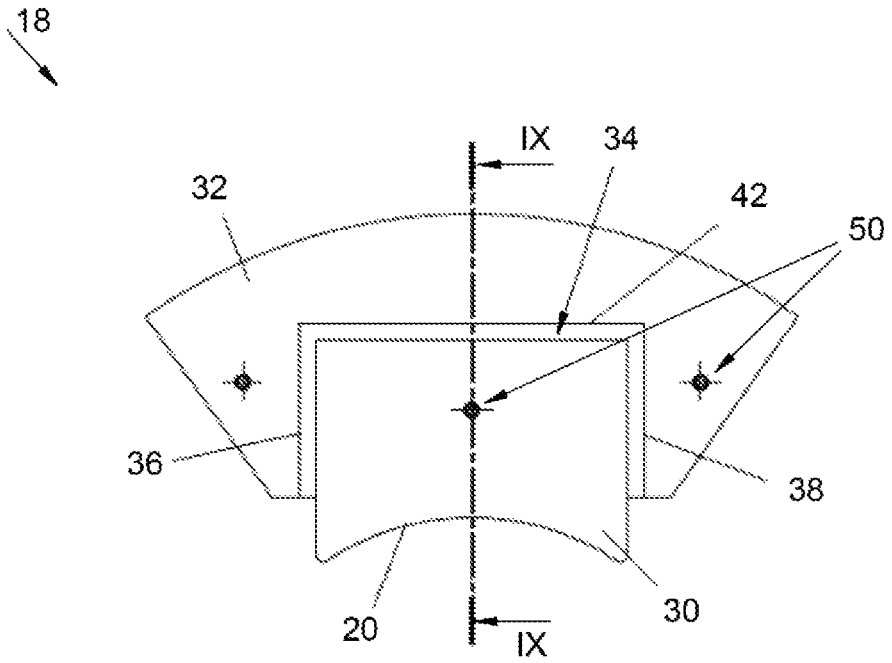
FIG. 8 shows a plan view of the body portion seen along arrow VIII in FIG. 7.
Figure 9:
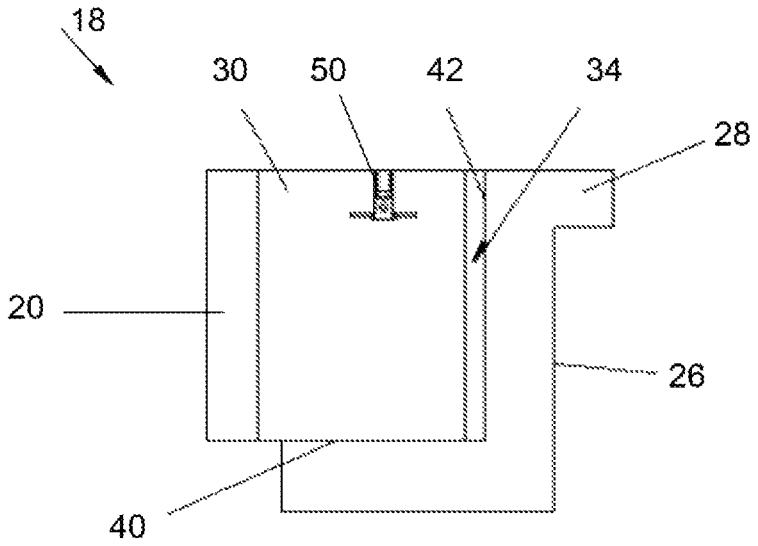
FIG. 9 is a sectional side view through the body portion seen along arrows IX-IX in FIG. 8.

Each body portion 18 has an inner surface 20 being arranged to have a shape complementary to an external surface 22 of the conductor casing 12 such that the inner surface 20 can abut against and/or engage with a portion of the external surface 22. Typically the inner surface 20 will have an arcuate configuration as is clearly shown in FIGS. 6 and 8.

In the preferred embodiment, the body portions 18 are supported in position against the conductor casing 12 by a conductor sleeve 24 surrounding the body portions 18. Each body portion 18 has an outer surface 26 arranged to have a shape complementary to the shape of the conductor sleeve 24 so that the body portions 18 can fit snugly within the conductor sleeve 24. The conductor sleeve 24 has an external shape complementary to the shape of the deck plate 14 surrounding the aperture so that the conductor sleeve 24 can be located within the aperture. In the exemplary embodiment, the conductor sleeve 24 will be cylindrical for location into the cylindrical aperture through the deck plate 14. The conductor sleeve 24 is preferably made from a metal material.

Alternatively, in other embodiments of the invention where the conductor sleeve 24 is not provided, the outer surface 26 of each body portion 18 can be arranged to have a shape being directly complementary to the shape of the deck plate 14 surrounding the aperture.

As can be more clearly seen in FIGS. 6 to 9, the body portion 18 is generally arcuate in shape when seen in top plan view. The body portion 18 has an outwardly protruding flange 28 for abutting against the conductor sleeve 24, or the deck plate 14, in order to help locate the body portion 18 in position.

In a preferred embodiment of the present invention the centralising device 10 comprises adjustment means for enabling adjustment of the position of the conductor casing 12 within the aperture.

The adjustment means comprises one or more of the body portions 18 having a first member 30 and a second member 32 being movable relative to each other. In the preferred embodiment the outer surface 26 is provided on the first member 30 and the inner surface 20 is provided on the second member 32, however it should be understood that this configuration may be interchanged without altering the scope of the present invention. In the exemplary embodiment the first member 30 comprises a recess 34 arranged to receive at least a portion of the second member 32 therein. The recess 34 comprises a width defined by side walls 36 and 38, a depth defined by base wall 40, and a length defined by rear wall 42.

The second member 32 is shaped complementary to the recess 34 such that the second member 32 may be at least in part, movably received within the recess.

The adjustment means further includes one or more spacers or packers 44 having a substantially uniform thickness 't', which are configured to be removably disposed, at least in part, within the recess 34 between the first member 30 and second member 32. The packers have a two-fold function. Firstly, the packers 44 permits the first member 30 to be positioned so that its inner surface 20 abuts against the conductor casing 12. Secondly, the packers 44 permit relative movement between the first member 30 and second member 32. Typically the thickness 't' will be between 1-20 mm however any other desired thickness can also be used to suit the size of the conductor casing 12. If needed, a variety of packers 80 having different thicknesses 't' will be available to permit various amounts of adjustment to be effected.

It will be appreciated that in use, when the outer surface 26 abuts against, the conductor sleeve 24 or the deck plate 14, one or more packers 44 can be inserted into or removed from the recess 34 to achieve adjustment of the position of the inner surface 20 and accordingly of the conductor casing 12 abutting against the inner surface 20. Thus inserting or removing a packer 44 adjacent either side wall 36, 38 will cause lateral adjustment of the inner surface 20 in a tangential direction with respect to the conductor casing 12. Similarly, inserting or removing a packer 44 adjacent the rear wall 42 will cause lateral adjustment of the inner surface 20 in a radial direction with respect to the conductor casing 12.

The centralising device 10 further includes one or more plates 46 arranged to be attached to the body portions 18. This can be done by inserting a fastener 48, such as a threaded bolt, into a complementary threaded hole 50 in the body portion 18. The plates 46 act to secure the centralising device 10 in position around the conductor casing 12, also ensuring that the packers 44 remain in position within the recess 34.

In use, an operator on a drill rig will select a conductor sleeve 24 having a suitable size and shape that will snugly fit within the aperture of the deck plate 14. The conductor casing 12 is positioned within the conductor sleeve 24 leaving a generally annular space 52 formed between the conductor casing 12 and the conductor sleeve 24. Sufficient body portions 18 are inserted between the conductor casing 12 and the conductor sleeve 24 to fill this space 52 and the packers 44 inserted into the recess 34 to bring the inner surface 20 into abutment with the conductor casing 12.

Depending on the alignment or eccentric shape of the aperture, an operator can adjust the position of the conductor casing 12 within the conductor sleeve 24 by inserting additional packers 44 into the recess 34 between the first member 30 and the second member 32, thereby to effect a selective and relative movement in the position of the inner surface 20. For example, in typical operating conditions there may be a gap of about 25 mm between the conductor casing 12 and the inner surface 20.

Once the requisite packers 44 are inserted into position, the operator will secure the plates 46 to the body portions 18. If necessary, one or more spacer shims 54 can be provided for connecting the plates 46 together.

Preferably, the body portions 18 are made of a non-compressible plastics material, for example such as a polyurethane material or a plastics composite. Using a plastics material decreases the weight of the centralising device and also improves sound suppression. The use of plastics material also assists in reducing corrosion, such as galvanic corrosion, by limiting contact between dissimilar metals.

Modifications and variations as would be apparent to a skilled addressee are deemed to be within the scope of the present invention.

The invention claimed is:

1. A centralising device for use in centralising a conductor casing within an aperture of a supporting framework, the centralising device comprising:

a body portion having an inner surface and an outer surface, the inner surface being arranged for abutting the conductor casing, the outer surface being arranged for abutting the framework, the body portion being adapted to be located in the aperture between the conductor casing and the framework for limiting movement of the conductor casing relative to the framework, and the body portion including adjustment means for enabling eccentric relative movement between the inner surface and the outer surface, wherein the body portion includes a first member and a second member, the second member being movable relative to the first member, wherein the outer surface is provided on the first member and the inner surface is provided on the second member; and a packer member being adapted to be located between the first member and the second member to cause the movement of the first member relative to the second member.

2. The centralising device of claim 1, wherein the relative movement is lateral movement in a tangential dimension of the conductor casing.

3. The centralising device of claim 1, wherein the relative movement is lateral movement in a radial dimension of the conductor casing.

4. The centralising device of claim 1, wherein the first member has a recess adapted to substantially receive at least a portion of the second member therein.

5. The centralising device of claim 1, further comprising a locking member for selectively limiting the relative movement between inner surface and the outer surface.

6. The centralising device of claim 1, wherein the body portion is made from a plastics material or a composite plastics material.

7. The centralising device of claim 1, further comprising a plurality of body portions adapted to be arranged adjacent to each other in an annular configuration for surrounding the conductor casing.

8. The centralising device of claim 1, further comprising at least three body portions.

9. The centralising device of claim 1, wherein the supporting framework is a deck plate of a drill rig.

10. The centralising device of claim 1, wherein the aperture has an annular configuration.

11. The centralising device of claim 10, wherein the annular configuration is an eccentric annular configuration.

12. A method for centralising a conductor casing within an aperture of a supporting framework, the method comprising the steps of:

providing a centralising device having a body portion with a first member comprising an outer surface and a second member comprising an inner surface, wherein the inner surface is arranged for abutting the conductor casing and the outer surface is arranged for abutting the framework, and the body portion includes adjustment means for enabling eccentric relative movement between the inner surface and the outer surface;

locating the body portion in the aperture between the conductor casing and the framework so that it limits movement of the conductor casing relative to the framework; and inserting or removing a packer member between the outer surface and the inner surface to cause relative movement between the inner surface and the outer surface.

13. The method of claim 12, further comprising the step of adjusting the position of the inner surface relative to the position of the outer surface.

14. The method of claim 12, further comprising the step of locking the body portion to selectively prevent relative movement between the inner surface and the outer surface.

15. The method of claim 12, further comprising the use of the centralising device of claim 1.

* * * * *